US010850950B2

(12) United States Patent
Chiasson

(10) Patent No.: US 10,850,950 B2
(45) Date of Patent: Dec. 1, 2020

(54) CRANE HAVING EFFECTIVELY COINCIDENT GANTRY AND BOOM FORCES UPON AN UPPERSTRUCTURE

(71) Applicant: OIL STATES INDUSTRIES, INC., Arlington, TX (US)

(72) Inventor: Christopher Paul Chiasson, Houma, LA (US)

(73) Assignee: OIL STATES INDUSTRIES, INC., Arlington, TX (US)

( * ) Notice: Subject to any disclaimer, the term of this patent is extended or adjusted under 35 U.S.C. 154(b) by 140 days.

(21) Appl. No.: 16/289,950

(22) Filed: Mar. 1, 2019

(65) Prior Publication Data

US 2019/0193999 A1 Jun. 27, 2019

Related U.S. Application Data

(63) Continuation-in-part of application No. 15/083,173, filed on Mar. 28, 2016, now Pat. No. 10,221,051.
(Continued)

(51) Int. Cl.
*B66C 23/36* (2006.01)
*B66C 23/52* (2006.01)
(Continued)

(52) U.S. Cl.
CPC ..... *B66C 23/36* (2013.01); *B66C 23/52* (2013.01); *B66C 23/62* (2013.01); *B66C 23/82* (2013.01);
(Continued)

(58) Field of Classification Search
CPC ..... B66C 23/02; B66C 23/08; B66C 23/10; B66C 23/16; B66C 23/163; B66C 23/66; B66C 23/821; B66C 23/84
See application file for complete search history.

(56) References Cited

U.S. PATENT DOCUMENTS 1,698,748 A 1/1929 Wilson
2,408,378 A 10/1946 Davenport et al.
(Continued)

FOREIGN PATENT DOCUMENTS

FR 2323623 4/1977
GB 2021518 12/1979

OTHER PUBLICATIONS

Verheul, Omiros, International Search Report and Written Opinion of the International Searching Authority, PCT/ IB2015/053316, dated Nov. 18, 2015, 12 pages, European Patent Office, Rijswijk, The Netherlands.
(Continued)

*Primary Examiner* — Emmanuel M Marcelo
(74) *Attorney, Agent, or Firm* — Polsinelli PC

(57) ABSTRACT

A crane includes a base, an upperstructure rotationally mounted on the base, a boom, and a gantry. The boom is pivotally attached to the upperstructure at a front attachment location and supports a load line operable to raise a payload. The gantry is mounted on the upperstructure and supports a boom line coupled to the boom. The gantry includes at least one front leg mechanically coupled to the front attachment location and inclined away from the boom to apply, to the front attachment location, a horizontal force component towards the boom opposed by a horizontal force component applied by the boom towards the front leg. The upperstructure includes a frustoconical turret forming an upper circle and a lower circle. The front attachment location is aligned over the upper circle of the frustoconical turret.

24 Claims, 15 Drawing Sheets

Related U.S. Application Data

(60) Provisional application No. 62/140,346, filed on Mar. 30, 2015.

(51) Int. Cl.
*B66C 23/84* (2006.01)
*B66C 23/82* (2006.01)
*B66C 23/62* (2006.01)
*B66C 23/64* (2006.01)

(52) U.S. Cl.
CPC ..... *B66C 23/84* (2013.01); *B66C 23/64* (2013.01); *B66C 2700/0357* (2013.01)

(56) References Cited

U.S. PATENT DOCUMENTS 2,414,573 A * 1/1947 Wagner ..... B66C 23/36 212/253
2,888,150 A 5/1959 Fox
2,919,876 A * 1/1960 Plain ..... F16M 11/28 248/123.2
3,076,560 A 2/1963 Bushong et al.
3,209,920 A 10/1965 De Cuir
3,485,383 A 12/1969 Beduhn
3,923,163 A 12/1975 Brewer
3,941,252 A * 3/1976 Six ..... B66C 23/84 212/181
3,954,020 A 5/1976 West et al.
3,957,161 A 5/1976 Tax
3,989,325 A 11/1976 Morrow, Sr. et al.
4,011,955 A 3/1977 Morrow, Sr. et al.
4,037,894 A 7/1977 Sankey
4,038,765 A 8/1977 Sankey
4,050,585 A * 9/1977 Wilms ..... B67D 9/02 137/615
4,061,230 A 12/1977 Goss et al.
4,076,128 A 2/1978 Tax
4,184,600 A 1/1980 Goss et al.
4,196,816 A 4/1980 Dvorsky et al.
4,216,870 A 8/1980 Bonneson et al.
4,391,341 A * 7/1983 Taghon ..... B62D 55/10 180/9.1
4,394,911 A 7/1983 Wittman et al.
4,513,869 A 4/1985 Goudy
4,524,875 A 6/1985 Jamieson
4,537,317 A 8/1985 Jensen
4,579,234 A 4/1986 Delago
4,635,803 A 1/1987 Foster et al.
4,711,358 A 12/1987 Konishi
4,863,044 A 9/1989 Trask et al.
4,892,202 A 1/1990 Hey et al.
5,018,630 A 5/1991 McGhie
5,035,337 A * 7/1991 Juergens ..... B66C 23/36 212/195
5,176,267 A 1/1993 Pech
5,265,741 A 11/1993 Shimizu et al.
5,310,067 A 5/1994 Morrow
5,328,040 A 7/1994 Morrow
5,580,189 A * 12/1996 Sanders ..... B66C 23/52 405/198
6,105,699 A * 8/2000 Hinds ..... B62D 33/063 180/89.13
6,508,372 B1 1/2003 Lamphen et al.
6,631,815 B1 10/2003 Laenge
7,007,764 B2 3/2006 Smith et al.
7,565,982 B2 7/2009 Kurotsu et al.
7,698,838 B1 * 4/2010 Strayhorn ..... E02F 3/425 37/395
8,863,966 B2 10/2014 Bobeck
2011/0031202 A1 2/2011 Pech et al.
2012/0241404 A1 9/2012 Bobeck

OTHER PUBLICATIONS

American Petroleum Institute Specification 2C, Offshore Pedestal Mounted Cranes, Sixth Edition, Mar. 2004, pp. 11-12, American Petroleum Institute, Washington, DC.
Model 353 Crane, brochure, Jan. 1989, 4 pages, LTV Energy Products Company, Houston, TX.
Nautilus® Marine Cranes, Pedestal Cranes and Services, brochure, 2011, 4 pages, Oil States Industries, Inc., Arlington, TX.
Nautilus® Marine Crane Exhibit at Petrotech—2010: 9th International Oil & Gas Conference, Oct. 31 to Nov. 3, 2010, New Delhi, India, 2 pages, Oil States Industries, Inc., Arlington, TX.
VG series jack-up vessels, published before Jan. 2015, 2 pages, GustoMSC, Schiedam, The Netherlands.

* cited by examiner

CRANE HAVING EFFECTIVELY COINCIDENT GANTRY AND BOOM FORCES UPON AN UPPERSTRUCTURE

CROSS REFERENCES TO RELATED APPLICATIONS

The present application is a continuation-in-part of application of U.S. patent application Ser. No. 15/083,173 filed Mar. 28, 2016, which claims the benefit of U.S. Provisional Application Ser. 62/140,346 filed Mar. 30, 2015 by Christopher Paul Chiasson entitled "Crane Having Effectively Coincident Gantry and Boom Forces Upon an Upperstructure" of which the full disclosures of these applications are incorporated herein by reference for all purposes.

FIELD

The present disclosure relates to a crane having a boom and a gantry mounted to an upperstructure rotationally mounted on a base.

BACKGROUND

A common form of crane has a base, an upperstructure rotationally mounted on the base, a boom having a proximal end pivotally attached to the upperstructure and having a distal end supporting a load line for raising a payload, and a gantry mounted on the upperstructure and having an upper end supporting a boom line coupled to the distal end of the boom for supporting the distal end of the boom. This common form of crane is often provided with a motor to swing the boom around the base, a boom hoist to raise or lower the inclination of the boom to align the distal end of the boom over the payload, and a load hoist to reel-in or reel-out the load line in order to raise or lower the payload.

The common form of crane introduced above is often used for pedestal mounted offshore cranes. An example is designated as a "Swing bearing mounted lattice boom wire luffed crane" in Figure 1 on page 2 of American Petroleum Institute Specification 2C, Offshore Pedestal Mounted Cranes, Seventh Edition, March 2012. In this example, the support base is a cylindrical pedestal, the upperstructure is generally rectangular, and the upperstructure is mounted to the pedestal via a swing-circle assembly for rotation about a vertical axis of the pedestal. The common gantry has a pair of rear legs mounted to the rear left and right of the upperstructure, and a pair of front legs mounted to the front left and right of the upperstructure, though different numbers of legs and different mounting positions for them do exist. The boom is a lattice boom pivotally connected to the front of the upperstructure. As a result, pedestal mounted offshore cranes typically use a four-legged gantry and six attachment locations on the upperstructure, including two attachment locations for a rear pair of gantry legs, two attachment locations for a front pair of gantry legs, and two attachment locations for a pair of boom legs at the proximal end of the boom. See, for example, Bonneson et al. U.S. Pat. No. 4,216,870 issued Aug. 12, 1980.

SUMMARY OF THE DISCLOSURE

The present disclosure describes a way of mounting a gantry and a boom to an upperstructure of a crane in order to reduce loading and bending moments upon the upperstructure and permit the upperstructure to have a reduced mass and a more compact size. The boom has a proximal end pivotally attached to the upperstructure at a front attachment location, and the gantry includes at least one front leg mechanically coupled to the front attachment location and inclined in a direction away from the boom to apply, to the front attachment location, a horizontal force component towards the boom that is opposed by a horizontal force component from the boom towards the front leg. Therefore there is a large reduction in the net horizontal force applied from the front attachment location upon the upperstructure, and consequently a reduced amount of structural mass is needed for reinforcing the front attachment location and strengthening the upperstructure to resist these forces, since the direction of the resultant forces are known to be mostly vertical.

Due to the reduction in the net horizontal force applied from the front attachment location of the boom to the upperstructure, the front attachment location can be brought closer to the center of the base of the crane, resulting in an additional reduction in the size and mass of the upperstructure. For a pedestal mounted crane, the upperstructure mass can be reduced further by using a circular turret as a primary component of the upperstructure, and locating the front attachment location on the circle of the turret.

In an arrangement, the front gantry leg provides a horizontal force component towards the boom that is equal and opposite to the horizontal force component from the boom towards the front gantry leg at the front attachment location. This can be true for all payloads and for all boom inclinations. The absence of any net horizontal force from the front attachment location to the upperstructure provides a minimum of force upon the upperstructure.

For example, the gantry can have four legs including a front pair of legs inclined in a direction away from the boom, and a vertical rear pair of legs, and each of the front legs can be attached to the upperstructure at a respective front attachment location at which the boom is pivotally attached to the upperstructure. In this example, the rear pair of legs does not apply a horizontal force component to the upperstructure, and consequently the front pair of legs provides a horizontal force component that is equal and opposite to the horizontal force component from the boom at the two front attachment locations. In this case, when the attachment locations for the rear legs are located on the rear of a circular turret, the horizontal force component and any bending moment from the rear legs can also be eliminated. This leads to an arrangement in which a four-legged gantry has four attachment locations aligned over the circle of the turret, and the two front legs are attached to the upperstructure at the two front attachment locations of the boom. For example, the four attachment locations are located at the four corners of a square circumscribed by the circle of the turret.

In an arrangement, the predictable downward force direction at all of the four attachment locations allows for further optimization of the upperstructure by completely transforming its overall shape from rectangular to circular. The circular pattern allows for direct integration of additional components of the upperstructure (such as ball rings, which are circular due to their function) onto the turret without needing any transitioning structure, making the upperstructure extremely mass-efficient. The circular shape of the upperstructure then gives the additional benefit of being naturally efficient at transmitting torque. When a crane is "twisted" due to a load being not underneath the distal end of the boom, or a strong wind, the upperstructure is what resists this load. The commonly used rectangular shapes are not mass-efficient at resisting torque because they are prone to twist. Therefore, a large amount of internal stiffening and support is required internal to most currently built upperstructures. However, transforming to a circular upperstructure means that the more efficient shape can resist the torsion without much additional bracing structure.

BRIEF DESCRIPTION OF THE DRAWINGS

Additional features and advantages of the present disclosure will be described below with reference to the drawings, in which.

Figure 1:
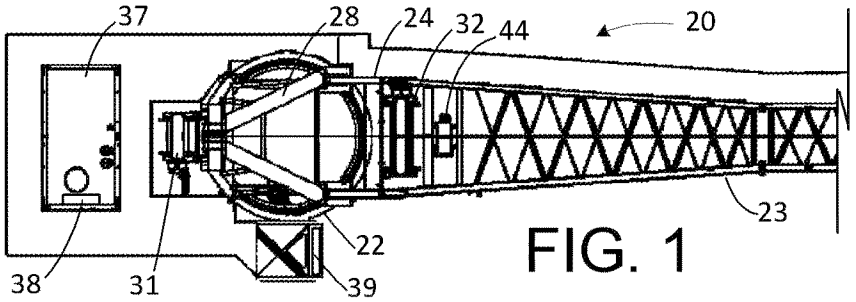
FIG. 1 is a top view of a crane having effectively coincident gantry and boom forces upon an upperstructure.

While the disclosed subject matter is susceptible to various modifications and alternative forms, specific examples have been shown in the drawings and will be described in detail. It should be understood, however, that it is not intended to limit the disclosure to the particular forms shown, but on the contrary, the intention is to cover all modifications, equivalents, and alternatives falling within the scope of the disclosure as defined by the appended claims.

DETAILED DESCRIPTION

It will be appreciated that for simplicity and clarity of illustration, where appropriate, reference numerals have been repeated among the different figures to indicate corresponding or analogous elements. In addition, while specific details are set forth in order to provide an understanding of the examples described herein, it will be appreciated by those skilled in the art that the examples described herein can be practiced without these specific details. In other instances, methods, procedures and components have not been described in detail so as not to obscure the related relevant feature being described. Also, the description is not to be considered as limiting the scope of the examples described herein. The drawings are not necessarily to scale and the proportions of certain parts may be exaggerated to better illustrate details and features of the present disclosure.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The terms "comprising," "including" and "having" are used interchangeably in this disclosure. The terms "comprising," "including" and "having" mean to include, but not necessarily be limited to the things so described.

Figure 2:
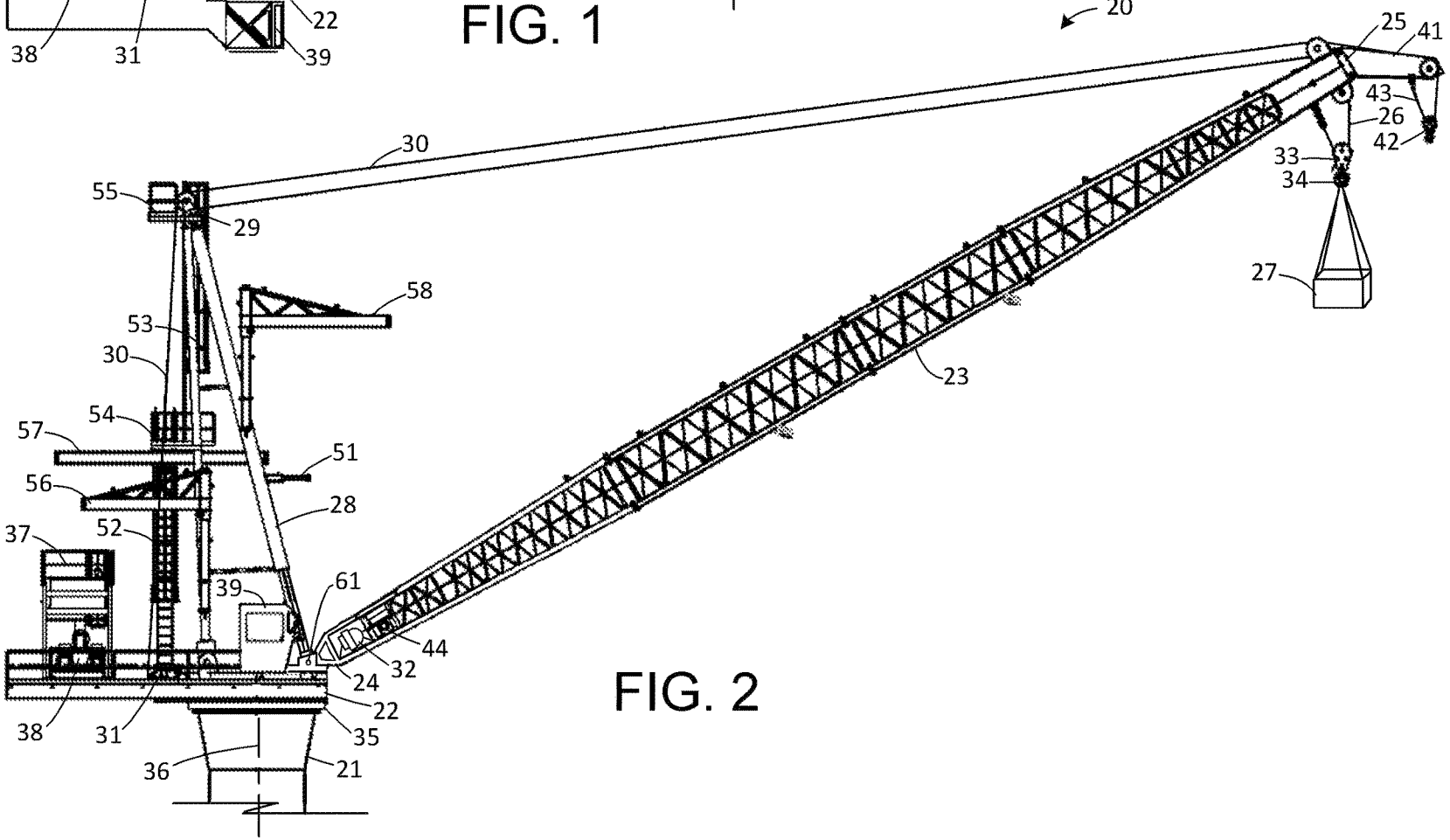
FIG. 2 is a side view of the crane introduced in FIG. 1.
Figure 3:
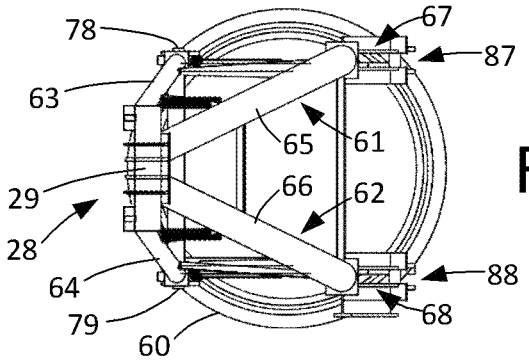
FIG. 3 is a top view of an assembly of a gantry and turret of the crane introduced in FIG. 1.
Figure 4:
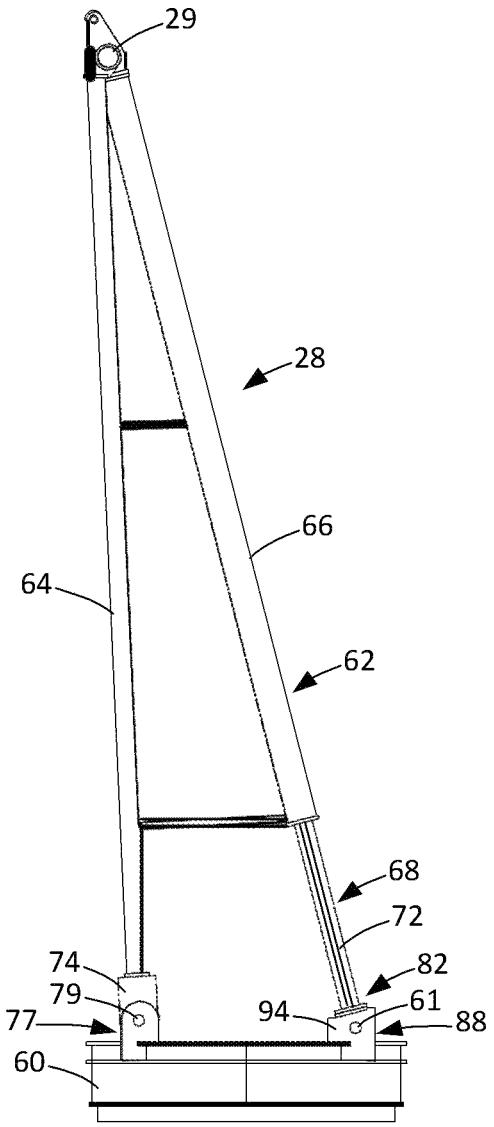
FIG. 4 is a side view of the assembly of FIG. 3.
Figure 5:
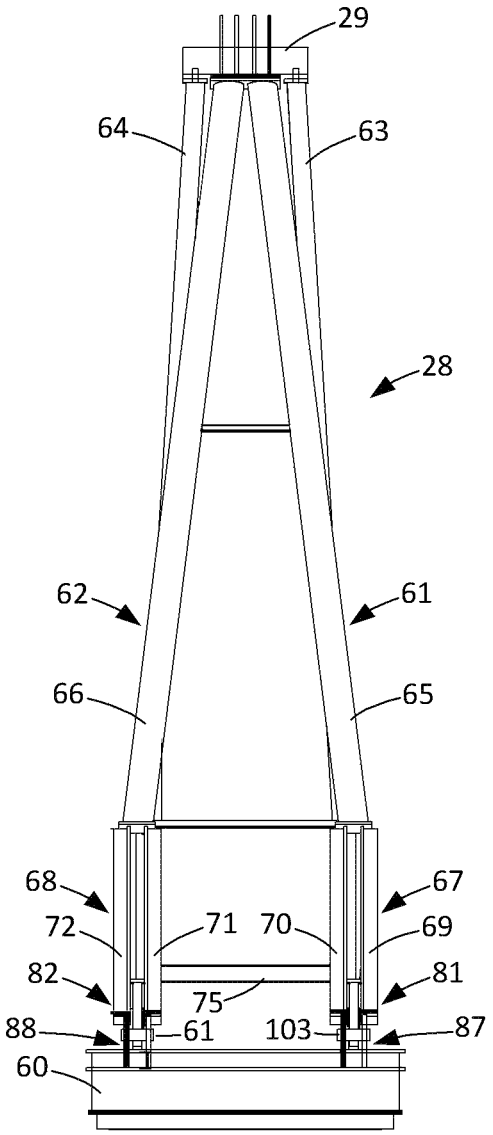
FIG. 5 is a front view of the assembly of FIG. 3.
Figure 6:
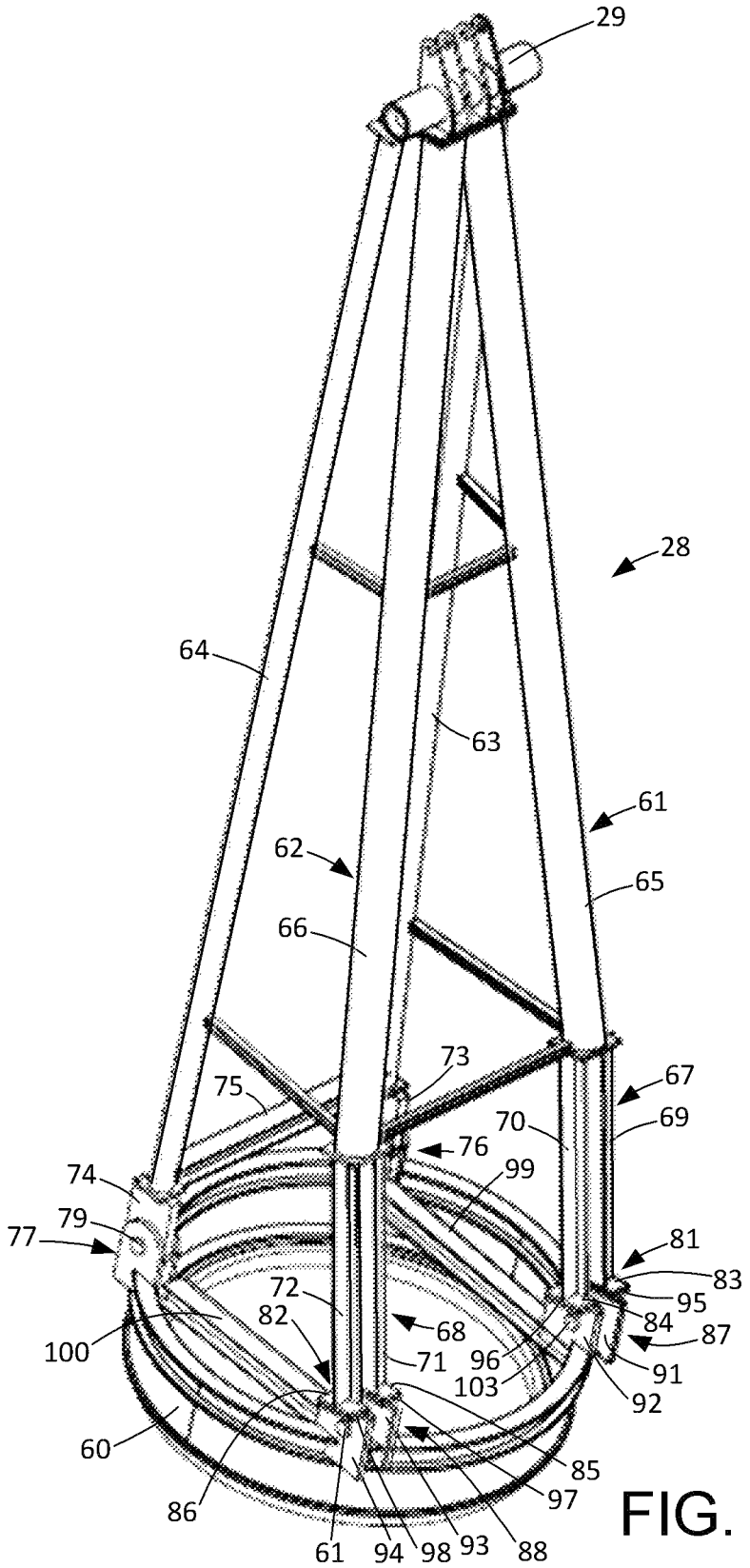
FIG. 6 is an oblique view of the assembly of FIG. 3.

FIGS. 1 and 2 show a crane 20. In general, the crane 20 includes a base (21 in FIG. 2), an upperstructure 22 rotationally mounted on the base 21, a boom 23 having a proximal end 24 pivotally attached to the upperstructure and having a distal end (25 in FIG. 2) supporting a load line (26 in FIG. 2) for raising a payload (27 in FIG. 2), and a gantry 28 mounted on the upperstructure and having an upper end 29 supporting a boom line (30 in FIG. 2) coupling the gantry to the distal end of the boom. The crane 20 also has a boom hoist 31 for reeling in or reeling out the boom line 30 to raise or lower the inclination of the boom 23 to align the distal end 25 of the boom over the payload 27, and a main load hoist 32 to reel-in or reel-out the load line 26 in order to raise or lower the payload.

In the example of FIGS. 1 and 2, a main load block (33 in FIG. 2) having a hook (34 in FIG. 2) is used for mechanically coupling the load line 26 to the payload 27. A two-part reeving of the load line 26 mechanically couples the load block 33 to the distal end 25 of the boom 23, and the payload 27 is hung from the hook 34. In a similar fashion, a two-part reeving of the boom line 30 mechanically couples the upper end 29 of the gantry 28 to the distal end 25 of the boom.

The crane 20 in FIGS. 1 and 2 is more specifically an example of a pedestal-mounted offshore crane having a lattice boom 23. The base 21 can be a cylindrical pedestal, and the upperstructure 22 is rotationally mounted to the pedestal via a swing-circle assembly (35 in FIG. 2).

Figure 20:
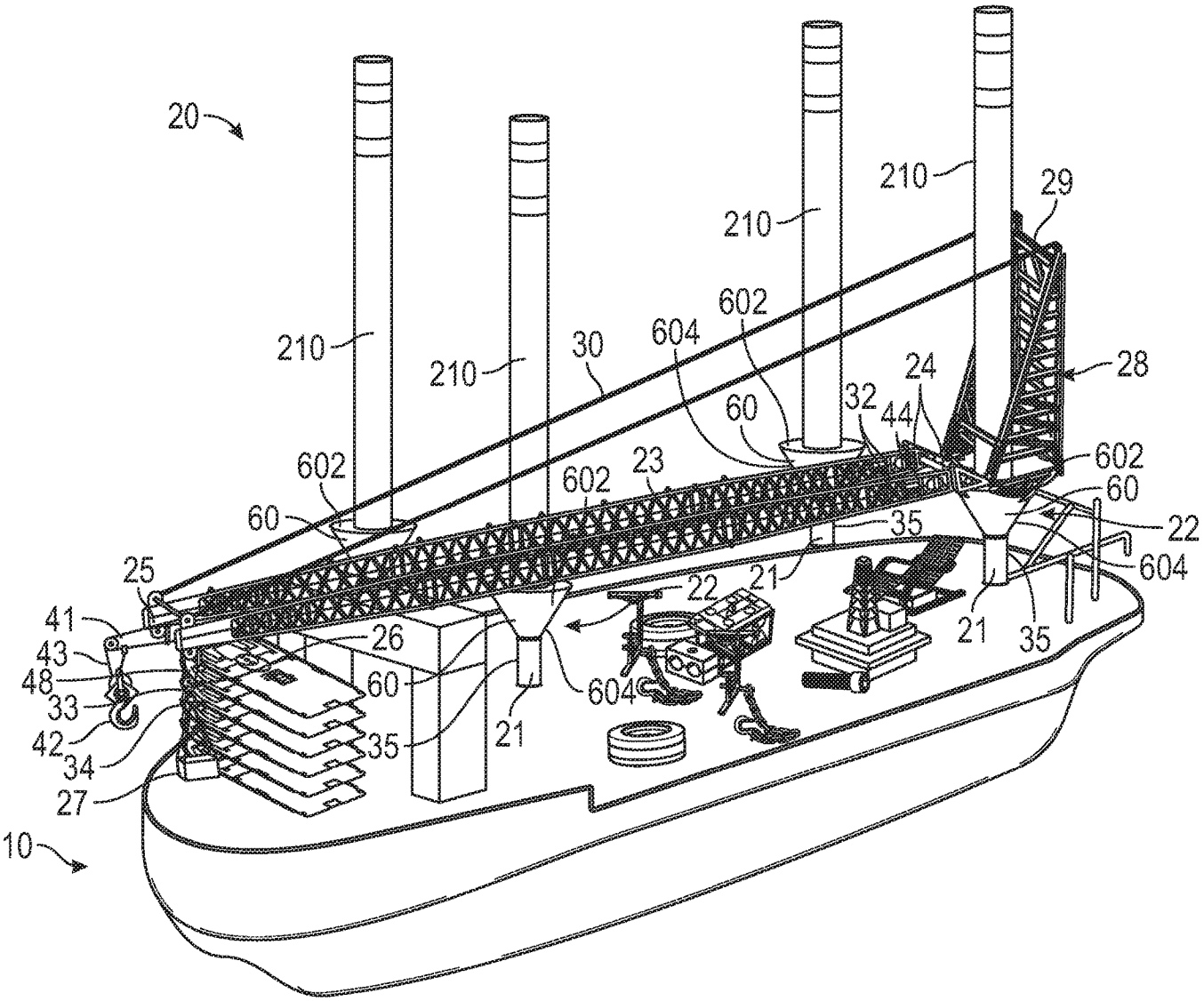
FIG. 20 is a side view of another example of a crane.
Figure 21:
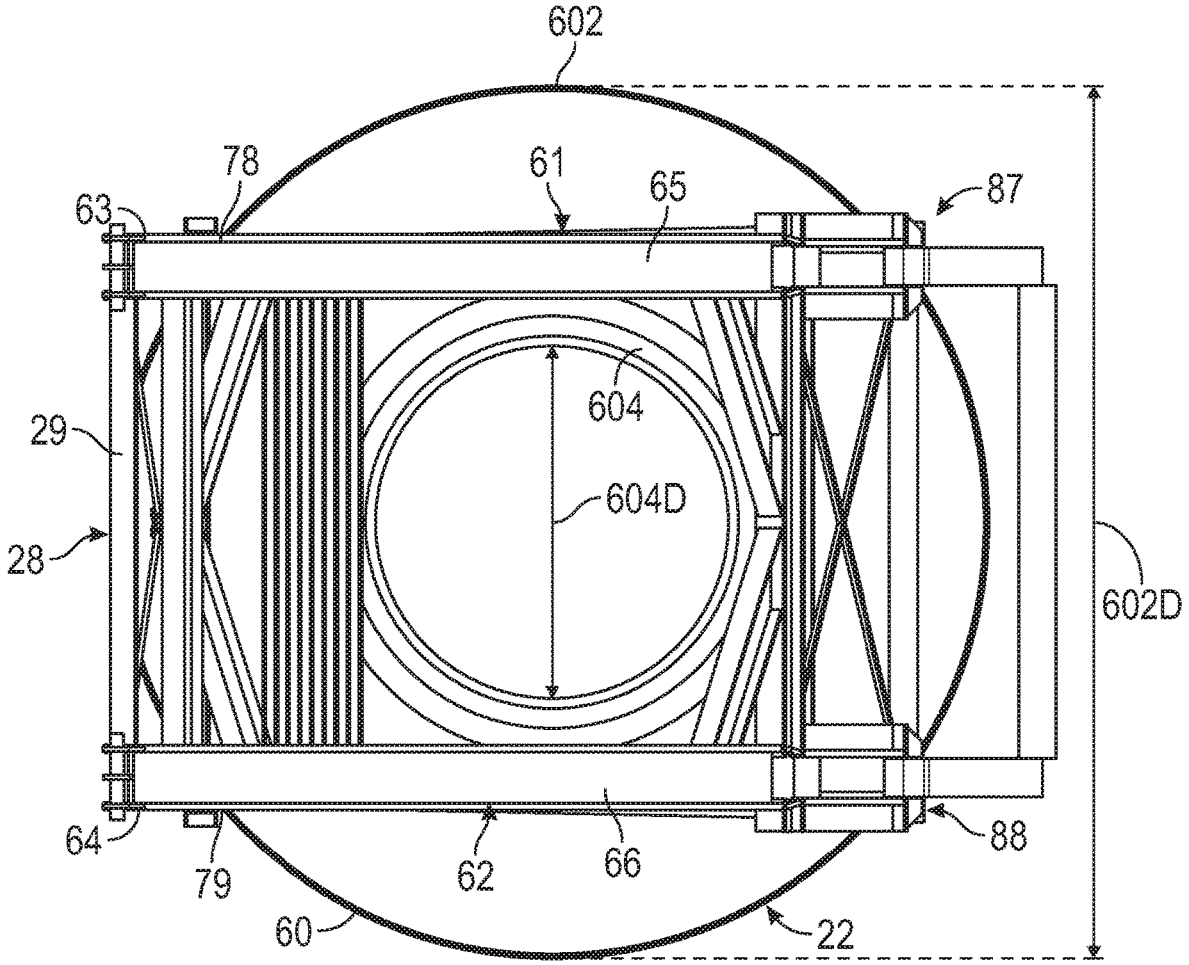
FIG. 21 is a top view of an assembly of a gantry and turret of the crane introduced in FIG. 20.
Figure 22:
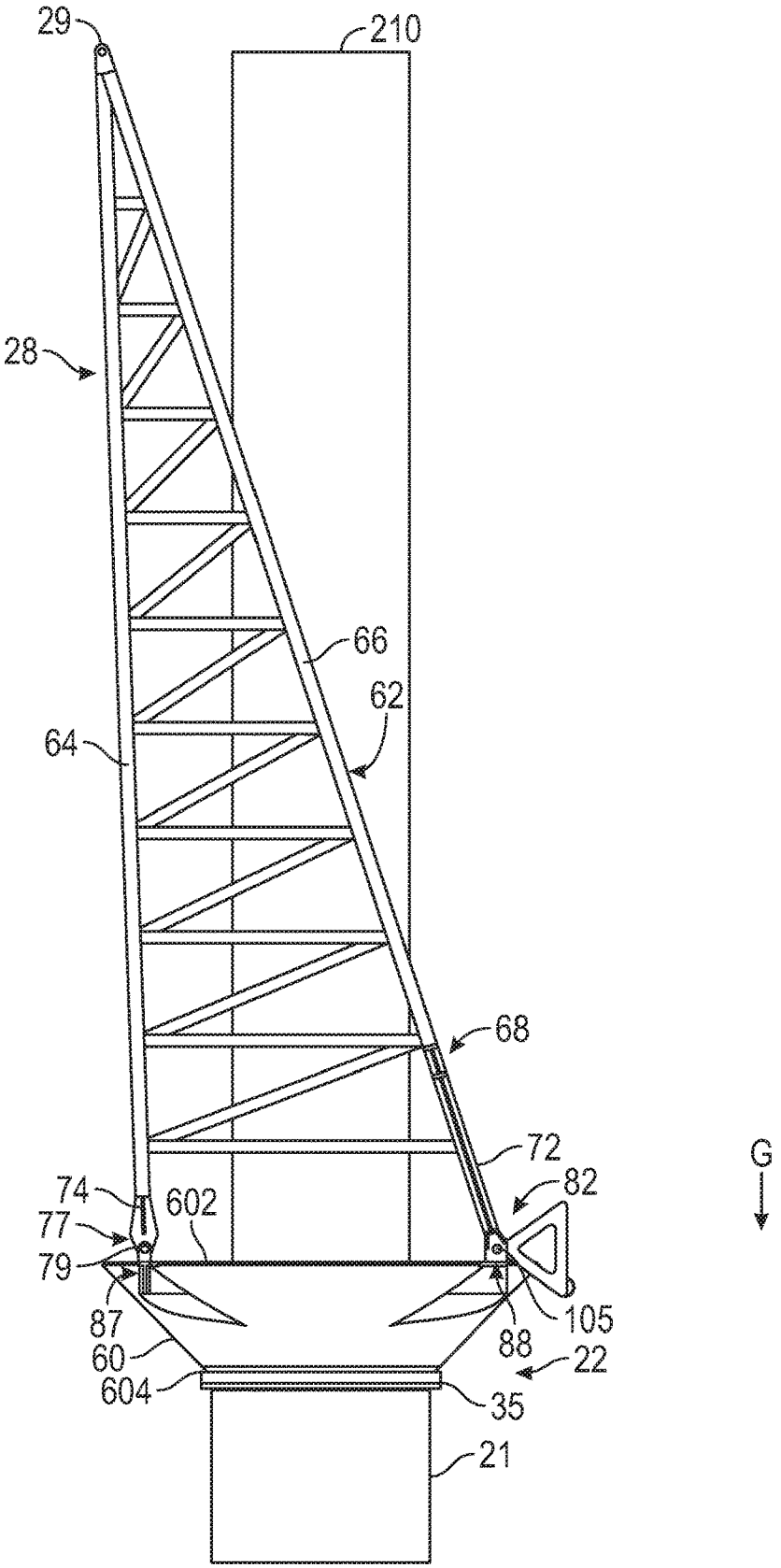
FIG. 22 is a side view of the assembly of FIG. 21.
Figure 23:
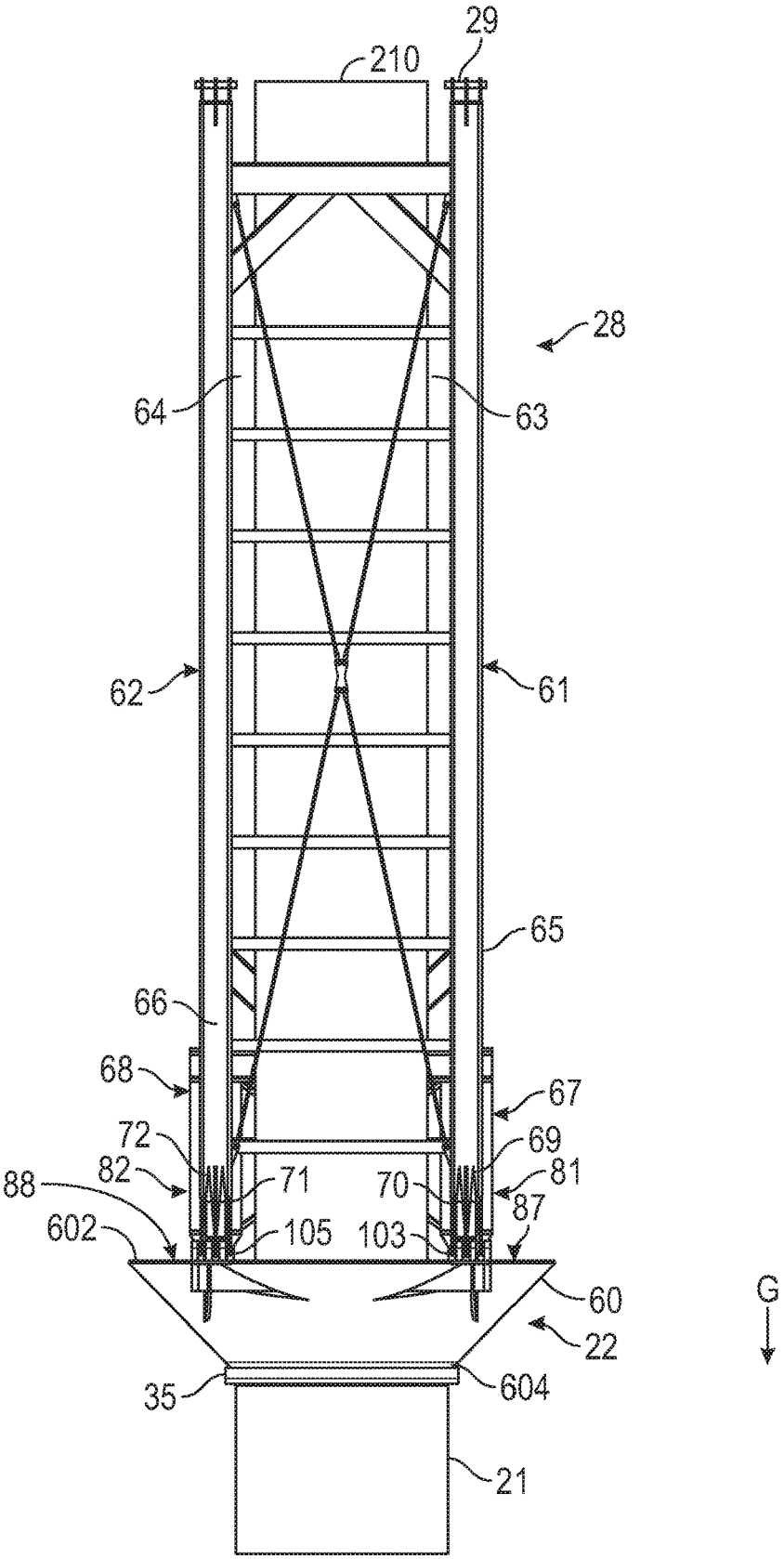
FIG. 23 is a front view of the assembly of FIG. 21.

FIG. 20 illustrates an example of a crane 20 which can be, for example, deployed on a structure 10, such as a ship or an offshore structure. In other examples, the crane 20 can be deployed on land. The base 21 can be a cylindrical pedestal, similar to the base 21 in FIGS. 1 and 2. In some examples, the base 21 can be a rectangular prism, frustoconical, and/or any other suitable shape to support and withstand the forces from the crane 20.

In at least one example, as illustrated in FIGS. 20-24, one or more legs 210 can extend vertically from the surface of the structure 10. The legs 210 can be coupled with the surface of the structure 10 such that the legs 210 are stable and can withstand the forces from the crane 20. As illustrated in FIGS. 20-24, the legs 210 can be substantially cylindrical. In other examples, the legs 210 can have a cross-section with a shape that is substantially circular, oval, rectangular, triangular, or any other suitable shape.

The base 21 can be positioned about the leg 210 such that the leg 210 extends vertically through the base 21. The base 21 can then be coupled with the surface of the structure 10. The upperstructure 22 can also be positioned about the leg 210. For example, the upperstructure 22 can be positioned on above, and/or coupled with, the base 21.

Relative directional terms such as above, below, upper, and lower are in relation to a gravity vector direction G. For example, the upperstructure 22 being positioned above the base 21 means that, in the gravity vector direction G, the order of the components is the upperstructure 22 and then the base 21. Similarly for upper and lower, in the gravity vector direction G, the order of the components is the upper component and then the lower component.

The swing circle assembly 35 selectively rotates the upperstructure 22 about a central vertical axis 36 of the pedestal 21, in order to swing the boom 23 around the pedestal. For example, the swing-circle assembly 35 has a circular array of hydraulic motors (121 to 128 in FIG. 10) mounted to the upperstructure 22, and each hydraulic motor has a pinion that meshes with a common internal gear mounted to the pedestal 21. A swing-circle assembly having such a gearing arrangement is well known, and details are found in Bonneson et al. U.S. Pat. No. 4,216,870 issued Aug. 12, 1980.

A diesel engine 37 is mounted on the rear end of the upperstructure 22 to drive a hydraulic pump 38 for powering the hydraulic motors in the swing-circle assembly 35. The hydraulic pump 37 also powers a hydraulic motor in the boom hoist 31, and a hydraulic motor in the main load hoist 32. An operator's cab 39 is mounted on the right side of the upperstructure 22. The operator's cab 39 includes manual controls for controlling the hydraulic motors to the lift the payload 27 from an initial location and to deposit the payload at a desired final location.

In the example of FIGS. 1, 2, and 20, the boom hoist 31 is mounted on the upperstructure 22 just to the rear of the gantry 28. In an alternative construction, the boom hoist 32 could be mounted on a pad (113 in FIGS. 9, 11, and 13-15) between the feet of the rear legs of the gantry 28. The main moist 32 is mounted to the boom 23 near the proximal end 24 of the boom.

For handling light-weight payloads, the distal end 25 of boom 23 can carry a jib (41 in FIGS. 2 and 20) supporting an auxiliary load block (42 in FIGS. 2 and 20). A two-part reeving of an auxiliary load line (43 in FIGS. 2 and 20) suspends the auxiliary load block 42 from the jib 41. An auxiliary load hoist 44 reels-in and reels-out the auxiliary load line 43 in order to raise or lower a light-weight payload (not shown) suspended from a hook on the auxiliary load block 42.

Although the primary purpose of the gantry 28 is for supporting the boom line 30, FIG. 2 shows a number of components mounted to the gantry for secondary functions. A boom stop 51 is mounted to the gantry 28 for abutting against the boom 23 when the boom reaches a maximum upward inclination. Ladders 52, 53 and platforms 54, 55 are mounted to the gantry 28 for the convenience of maintenance personnel. Horizontal jibs 56, 57, 58 are mounted to the gantry 28 for lifting, removing, and replacing components that may need service. A horizontal jib 56 is provided for servicing of the boom hoist 31. An extendable horizontal jib 57 is provided for servicing the diesel engine 37. A horizontal jib 58 is provided for servicing the main and auxiliary load hoists 32, 44.

It is desired to attach the gantry 28 and the boom 23 to the upperstructure 22 in such a way that boom forces are effectively coincident with gantry forces so that the forces upon the upperstructure from the boom are minimized. In the example of FIGS. 1, 2, and 20, this is done by sharing the locations of attachment of the proximal end 24 of the boom 23 on the upperstructure with two respective locations of attachment of an inclined front pair of legs of the gantry 28 on the upperstructure.

FIGS. 3-7 and 21-24 show details of a left front location of attachment 87 and a right front location of attachment 88 on a turret 60 of the upperstructure. The front pair of gantry legs includes a left front leg 61 and a right front leg 62. A foot 81 of the left front leg 61 stands on the left front attachment location 87, and the left front attachment location 87 receives a left foot pin 103 for pivotally attaching a left leg (101 in FIG. 7) of the boom 23 to the upperstructure. The foot 81 is aligned with the left foot pin 103. A foot 82 of the right front leg 62 stands on the right front attachment location 88, and the right front attachment location 88 receives a right foot pin 61 for pivotally attaching a right leg (102) of the boom 23 to the upperstructure.

The pair of front legs 61, 62 of the gantry 28 extends from the two respective front attachment locations 87, 88 on the upperstructure 22 to the upper end 29 of the gantry 28, and the proximal end 24 of the boom 23 is attached to the upperstructure 22 at the two respective front attachment locations, and the pair of front legs is inclined in a direction away from the boom 23 to apply, to each of the two respective front attachment locations, a horizontal force component towards the boom that is canceled by a horizontal force component applied by the boom towards the pair of front legs. The horizontal force component applied by the pair of front legs 61, 62 is seen in FIG. 2 to arise from tension in the boom cable 30, which pulls the upper part 29 of the gantry 28 towards the distal end 25 of the boom. Movement of the upper part 29 of the gantry 28 in the horizontal direction towards the distal end of the boom is resisted by an axial compression force in the front legs 61, 62. Due to the inclination of the front legs 61, 62 away from the boom 23, this axial compression force has a horizontal force component towards the boom, and this horizontal force component is proportional to the axial compression force and the sine of the angle of deviation of the pair of front legs 61, 62 from vertical.

Moreover, in the example of FIGS. 1-8 and 20-24, the gantry 28 has a rear pair of legs 63, 64, and the rear pair of legs is vertical in comparison to the font pair of legs which is inclined backwards. Therefore, the rear pair of legs 63, 64 does not apply any significant horizontal force to the upperstructure 22, and the rear pair of legs 63, 67 applies a vertical upward force upon the upperstructure 22. Consequently, the horizontal component of the force applied by the boom 23 upon the foot pins 103, 61 is balanced by an opposing horizontal component of force applied by the pair of front legs 67, 68 of the gantry 28 upon the two front attachment locations 87, 88. Therefore the two front attachment locations do not transmit any significant horizontal force to the upperstructure 22, and the net force is downward in a vertical direction. This further minimizes the forces upon the upperstructure from the boom, and further minimizes bending or torsion at all four locations 87, 88, 76, 77 where the four gantry legs 61, 62, 63, 64 are attached to the upperstructure 20.

FIGS. 3-6 and 21-24 show further details of the gantry 28 and its attachment to the turret 60 of the upperstructure. The two front legs 61, 62, are similar to each other, and the two rear legs 63, 64 are similar to each other. Each rear leg 63, 64 is a straight cylindrical steel tube. Each front leg 61, 62 is an elongated steel assembly including a respective straight upper tubular section 65, 66 and a respective straight lower section 67, 68. Each straight lower section 67, 68 is comprised of a pair of parallel spaced steel beams 69, 70 and 71, 72. The lower sections 67, 68 of the front leg 61, 62 are parallel to each other. The upper sections 65, 66 of the front legs are not parallel to each other and instead taper towards each other for a minimal spacing at the upper end 29 of the gantry 28. The lower section 67 of the left front leg 61 has a longitudinal axis that is aligned with the left front foot pin 103, and the lower section 68 of the right-front leg 62 has a longitudinal axis that is aligned with the right front foot pin 61.

Figure 8:
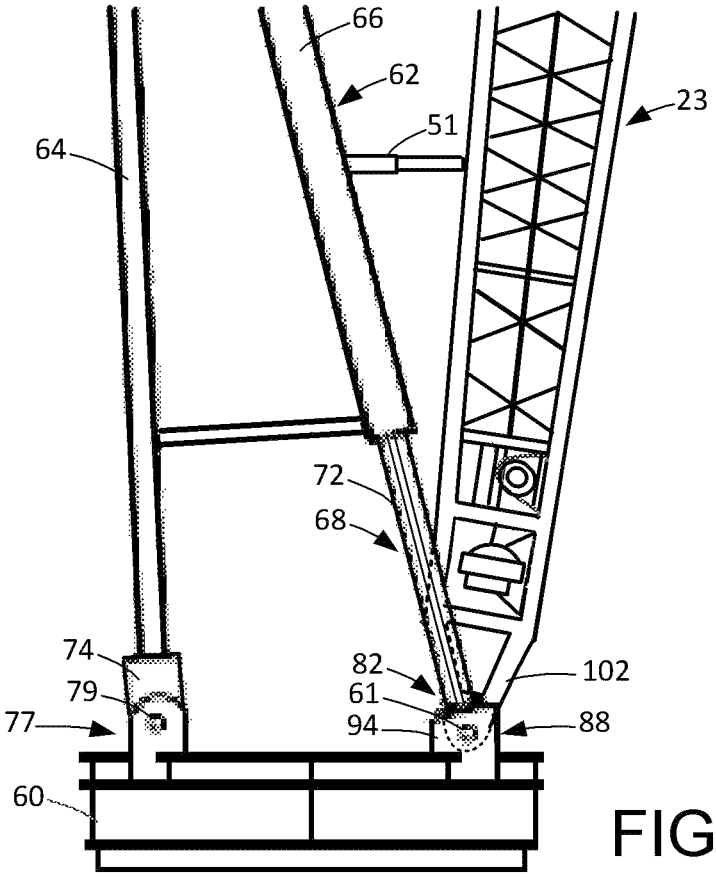
FIG. 8 is a side view showing the boom in a position of maximum upward inclination with respect to the assembly of FIG. 3.
Figure 9:
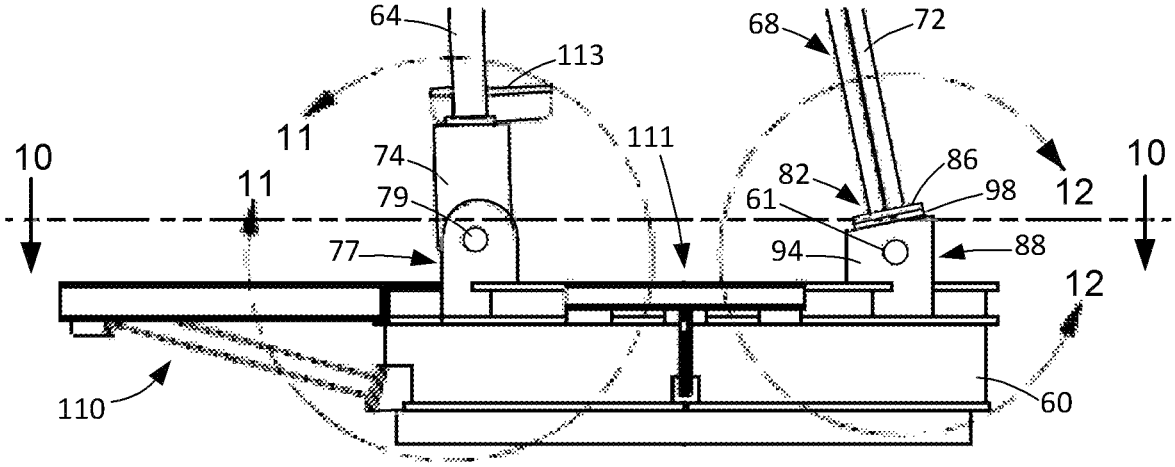
FIG. 9 is a side view of the assembly of FIG. 3 showing additional components attached to the turret.

The spacing between the two parallel spaced beams in each pair of parallel spaced beams 69, 70 and 71, 72 provides a clearance fit with a respective leg of the proximal end of the boom, so that an upper and rearward portion of the respective leg of the proximal end of the boom is received between the two parallel spaced beams when the boom is at a maximum upward inclination (as shown in FIG. 8). For example, each parallel spaced steel beam has an "I" or "T" shaped-cross section, and the head of the "I" or "T" of one beam in each pair faces the head of the "I" or "T" of the other beam in the pair.

The turret 60, as illustrated in FIGS. 1-8, is a primary cylindrical component of the upperstructure (22 in FIG. 2). The base of the turret 60 is configured to sit upon the top of the pedestal base (21 in FIG. 2) in coaxial alignment with the vertical axis (36 in FIG. 2) of the pedestal base. The swing-circle assembly (35 in FIG. 2) rotationally couples the base of the turret 60 with the top of the pedestal base (21 in FIG. 2) so that any torsional moments upon the turret about the vertical axis (36 in FIG. 2) are transmitted to the pedestal base. Such bending moments arise during normal operation of the crane due to the lifting of the payload (27 in FIG. 2).

Each rear leg 63, 64 of the gantry 28 has a respective foot 73, 74 that is a steel pad-eye plate, and the upper parts of the two feet 73, 74 are joined by a horizontal steel beam 75. Each of the two feet 73, 74 are received between a respective pair 76, 77 of parallel-spaced vertical steel pad-eye plates welded onto the turret 60, and a respective foot pin 78, 79 attaches the respective foot 73, 74 to the turret 60 via the respective pair 76, 77 of pad-eye plates welded to the turret. Thus, the turret 60 is an efficient circular barrel-like structure that spreads out point-like contact forces of the boom and gantry before these forces are applied to bearing elements of the swing-circle assembly (35 in FIG. 2).

FIGS. 21-24 illustrate an example of a turret 60, which has a frustoconical shape. The frustoconical turret 60 forms an upper circle 602 and a lower circle 604. The upper circle 602 has a diameter 602D, and the lower circle 604 has a diameter 604D. The diameters 602D, 604D are influenced by economics of production for taller upperstructures 22, and by structural feasibility for short upperstructures 22. For example, for taller upperstructures 22, the diameters 602D, 604D of the upper circle 602 and the lower circle 604 may not cause a steep wall slope, but the upperstructure 22 may become larger and thus more expensive. For shorter upperstructures 22, the diameters 602D, 604D of the upper circle 602 and the lower circle 604 may cause a steep wall slope, as the upperstructure 22 may become a near-flat dish and thus structurally infeasible.

In at least one example, for example as illustrated in FIGS. 20-24, the diameter 602D of the upper circle 602 is larger than the diameter 604D of the lower circle 604. In other examples, the diameter 602D of the upper circle 602 can be smaller than the diameter 604D of the lower circle 604. The frustoconical turret 60 is oriented such that the upper circle 602 is above the lower circle 604 in relation to the gravity vector direction G. When the frustoconical turret 60 is positioned on the base 21, the lower circle 604 is adjacent to the base 21.

Similar to FIGS. 1-8, the swing-circle assembly 35 rotationally couples the lower circle 604 of the turret 60 with the top of the pedestal base 21 so that any torsional moments upon the turret 60 about the vertical axis (36 in FIG. 20) are transmitted to the pedestal base 21. In at least one example, the crane 20 may disengage its slewing brakes as the crane 22 is about to pick up a load. During such action, the torsion on the upperstructure 22 may not be resisted by the pedestal base 21 to allow the crane 20 to automatically align the boom 23 over the load 27. The ring bearings of the swing-circle assembly 35 (illustrated in FIG. 10) are coupled with the lower circle 604 of the frustoconical turret 60, as the lower circle 604 functions as the base of the turret 60. Such bending moments arise during normal operation of the crane due to the lifting of the payload (27 in FIG. 20). In at least one example, moments or torques about the vertical axis may be of lower importance to overturning moments. Overturning moments can be classified as primary or secondary. Primary overturning moments attempt to topple the crane 20 forward (about an axis parallel to the boom heel pins). Secondary overturning moments attempt to topple the crane 22 sideways left or right.

The frustoconical shape of the turret 60, as illustrated in FIGS. 21-24, provides for a smaller swing-circle assembly 35 in relation to the weight capacity of the crane 20. Additionally, in at least one example, the shape of the turret 60 can provide for a smaller swing-circle assembly 35 in relation to the size of the non-rotating obstructions the crane 20 should avoid, such as the legs 210 of a liftboat. For example, if the turret is cylindrical, a greater weight capacity requires a larger diameter of the turret and corresponding ring bearing (illustrated in FIG. 10) in the swing-circle assembly 35. The cost of ring bearings as the diameter increases is not linearly proportional. As the diameter of the ring bearing increases, the cost increases at a greater rate. With a frustoconical turret 60, the weight capacity of the crane 20 may require a larger upperstructure, but the diameter of the ring bearing can be smaller Similar to the turret 60 in FIGS. 2-8, the circular shape of the upper circle 602 of the frustoconical turret 60 spreads out the point-like contact forces of the boom and gantry before the forces are applied to the bearings of the swing-circle assembly 35. The larger upper circle 602 provides for the larger upperstructure connection, but the lower circle 604 and the corresponding swing-circle assembly 35 and ring bearings can have a smaller diameter 604D than the upper circle 602. The forces enacted on the upper circle 602 are distributed through the frustoconical turret 60 such that ring bearings with a smaller diameter can be utilized, thereby saving cost.

Each front leg 61, 62 has a respective foot 81, 82 including a respective steel plate (83, 84, 85, 86 in FIGS. 6 and 24) welded to the bottom end of each beam 69, 70, 71, 72 so as to be perpendicular to the longitudinal axis of each beam. Each front leg 61, 62 stands on a respective mount 87, 88 welded onto the turret 60. Each mount 87, 88 includes a respective pair of parallel-spaced vertical steel pad-eye plates (91, 92, 93, 94 in FIGS. 6 and 24) welded onto the turret 60, and a respective inclined steel plate (95, 96, 97, 98 in FIGS. 6 and 24) welded perpendicular to each of the pad-eye plates (91, 92, 93, 94 in FIGS. 6 and 24) so as to be parallel to and aligned with a matching plate on the foot of the neighboring front leg 61, 62. The foot of each front leg is attached to the turret 60 by fastening the matching plates together, for example by welding around the outer neighboring edges of the matching plates, or by bolting the matching plates together.

Figure 24:
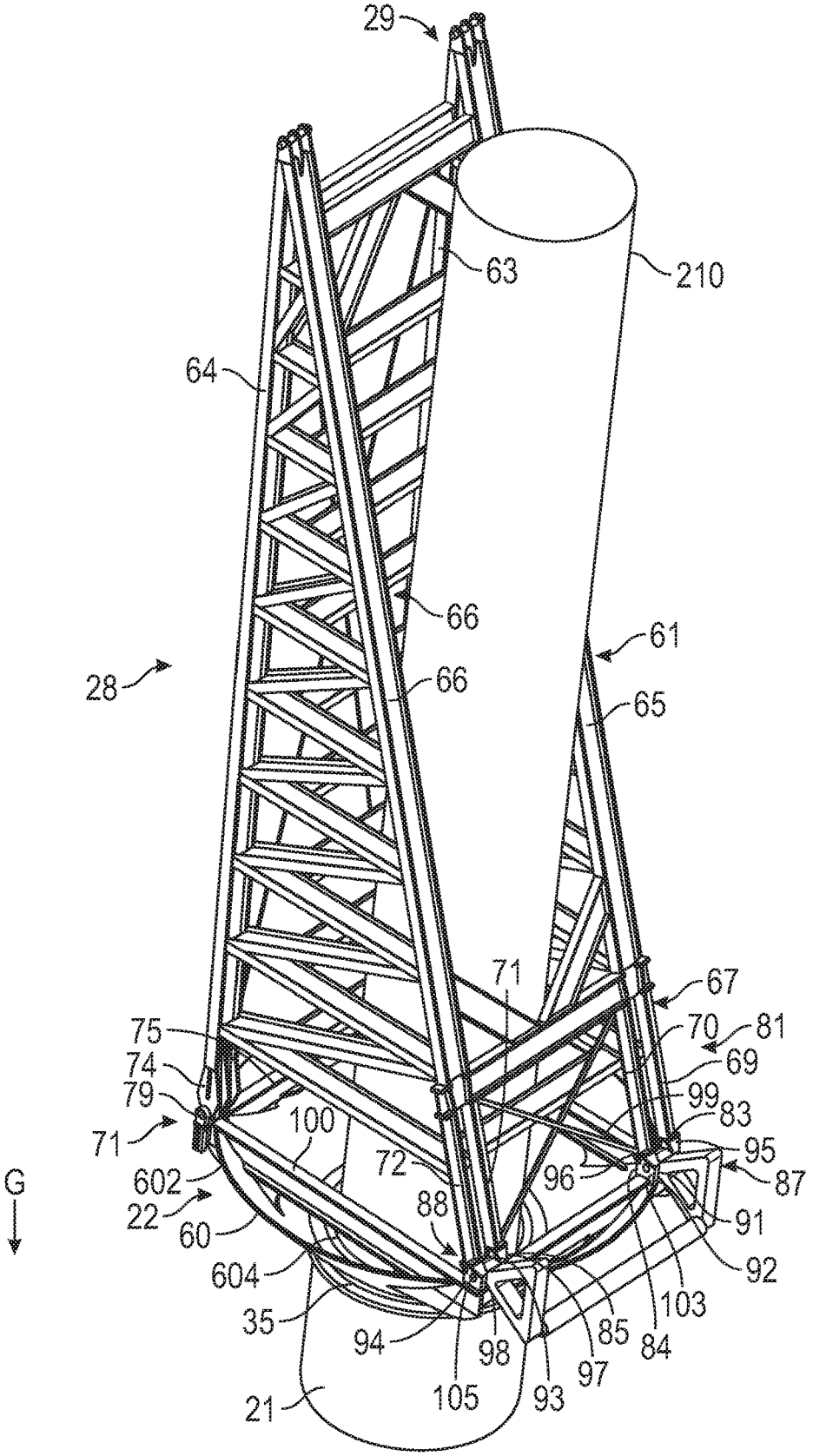
FIG. 24 is an oblique view of the assembly of FIG. 21.

A pair of parallel-spaced steel beams 99, 100 is disposed within the turret 60 to brace the gantry leg mount locations on the turret 60. While the disclosure discusses the beams 99, 100 as steel beams, in some examples, the beams 99, 100 can be made of other metals, alloys, polymers, or any other suitable material. A left beam 99 has a front end welded to the internal surface of the turret 60 just below the left front mount 87, and a rear end welded to the internal surface of the turret 60 just below the left rear mount 76. A right beam 100 has a front end welded to the internal surface of the turret 60 just below the right front mount 88, and a rear end welded to the internal surface of the turret 60 just below the right rear mount 77. As illustrated in FIG. 24, the beams 99, 100 assist in redirecting the vertical load diagonally down the frustoconical turret 60. Accordingly, the vertical load is distributed through the turret 60.

Figure 7:
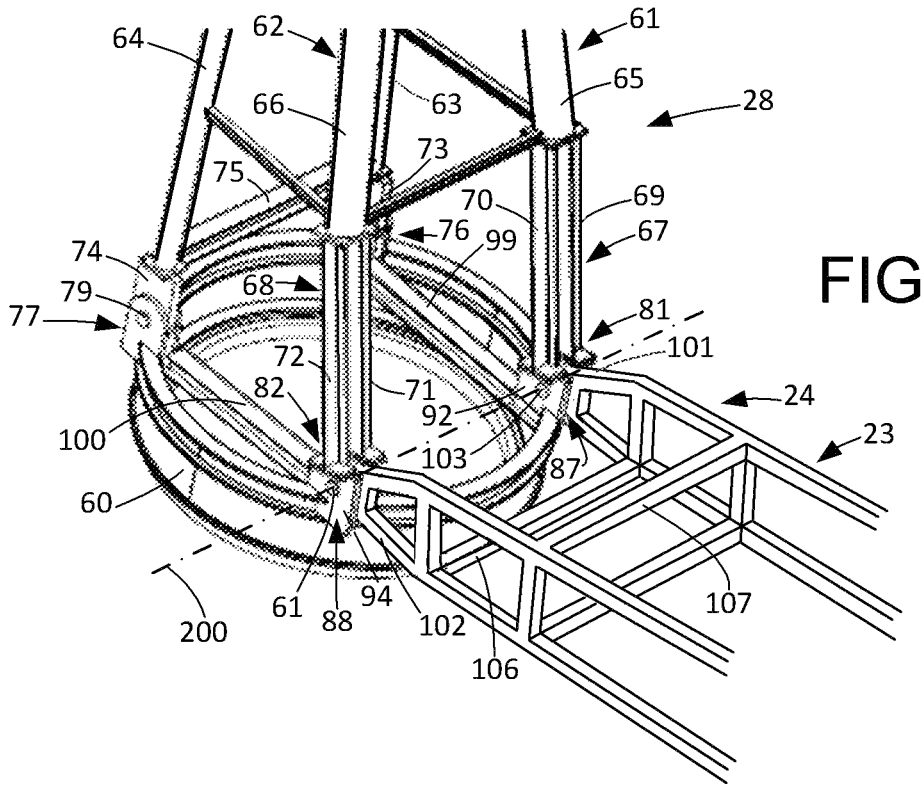
FIG. 7 is an oblique view showing the proximal end of the boom pivotally connected to the assembly of FIG. 3.

FIG. 7 shows the proximal end 24 of the boom 23 attached to the turret 60 at the front mounts 87, 88. The proximal end 24 of the boom 23 includes a left leg 101 and a right leg 102. A left foot pin 103 secures a left foot of the left leg 101 in the left front mount 87, and a right foot pin 61 secures a right foot of the right leg 102 in the right front mount 88. Each front gantry leg 61, 62 carries a compressive force having a line of action passing through a pivot axis 200 of the boom 23 at the respective front attachment location 87, 88. The line of action is the longitudinal axis of the lower portion 67, 68 of the front gantry leg 61, 62. The pivot axis 200 of the boom 23 extends from the left foot pin 103 to the right foot pin 61. The left and right foot pins 103, 61 are coaxial with the pivot axis 200 of the boom 23, so that longitudinal axis of the left front foot pin 103 is the pivot axis 200, and the longitudinal axis of the right foot pin 61 is also the pivot axis 200.

FIG. 8 shows the boom 23 in a position of maximum upward inclination. In this case the upper and rear part of the left leg 101 of the boom 23 is received between the beams 69 and 70 of the left front gantry leg 61, and the upper and rear part of the right leg 102 of the boom 23 is received between the beams 71 and 72 of the right front gantry leg 62. So as not to interfere with the beams 70 and 71, the first upper lateral (i.e., right-to-left) brace (107 in FIG. 7) of the boom 23 is further from the proximal end 24 of the boom 23 than the first lower lateral brace (106 in FIG. 7) of the boom.

FIGS. 9, 10, 11, 12, 13, 14, and 15 show some additional components mounted to the turret 60. An engine support structure 110 is mounted on the rear of the turret 60. A cab support structure 111 is mounted on the right side of the turret 60. These structures are made of steel beams welded to each other or welded to the turret 60. As shown in FIGS. 10 and 13 to 15, a hydraulic motor mounting structure 112 is disposed within the turret 60 and welded to the turret. As shown in FIGS. 9, 11, and 13 to 15, a boom hoist mounting pad 113 is welded to the beam 75 between the rear legs 63, 64 of the gantry.

Figure 10:
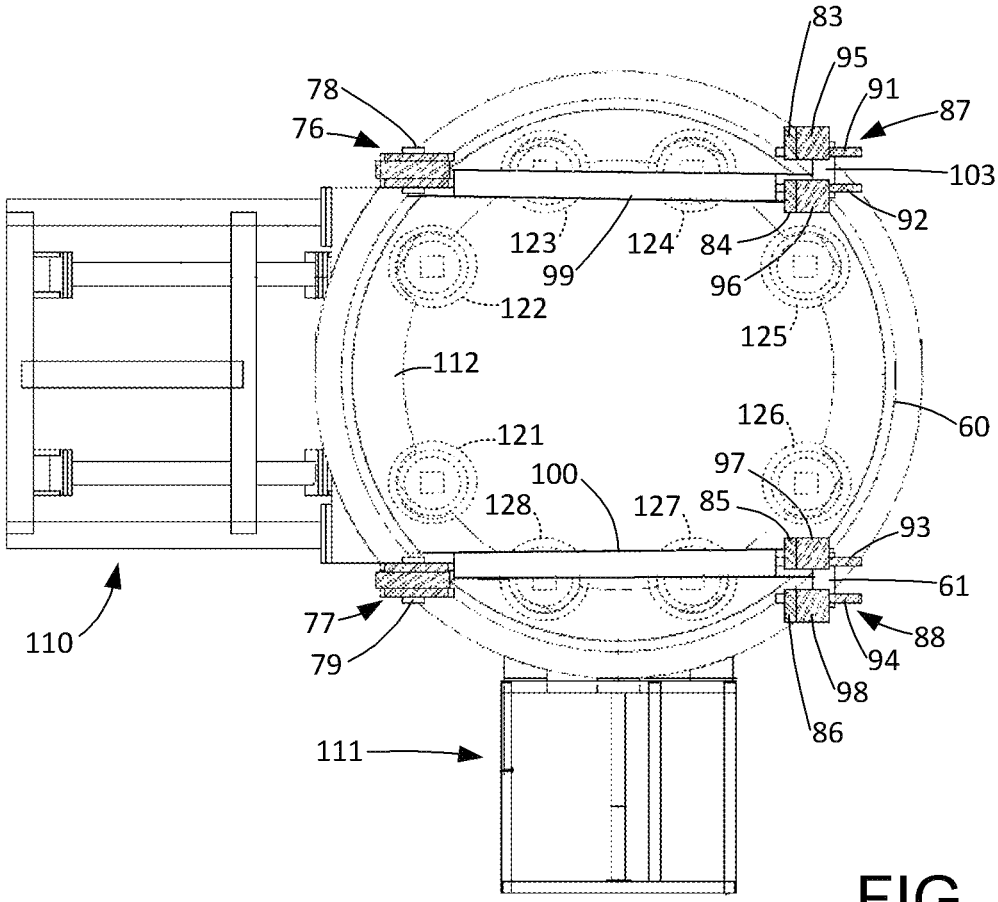
FIG. 10 is a top section view of the assembly of FIG. 9 along line 10-10 in FIG. 9.
Figure 11:
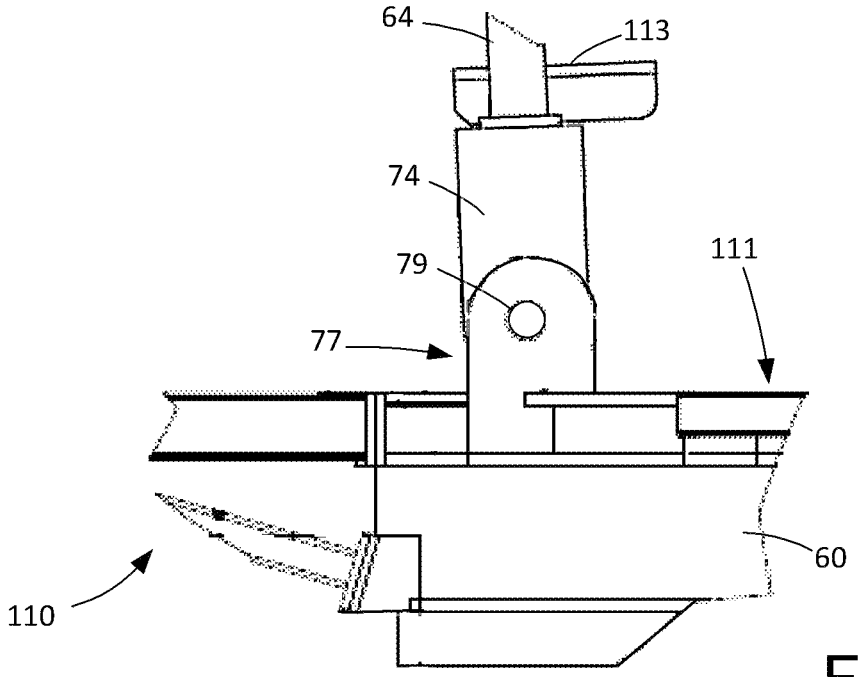
FIG. 11 is an expanded side view within a boundary line 11-11 in FIG. 9.
Figure 12:
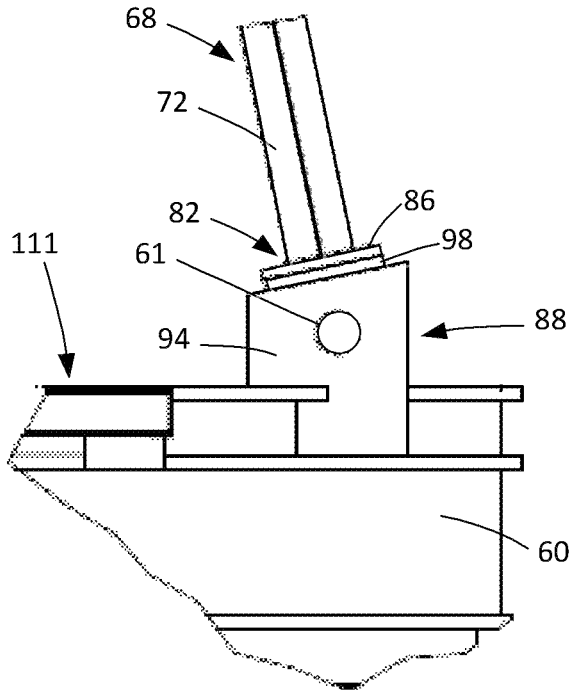
FIG. 12 is an expanded side view within a boundary line 12-12 in FIG. 9.
Figure 13:
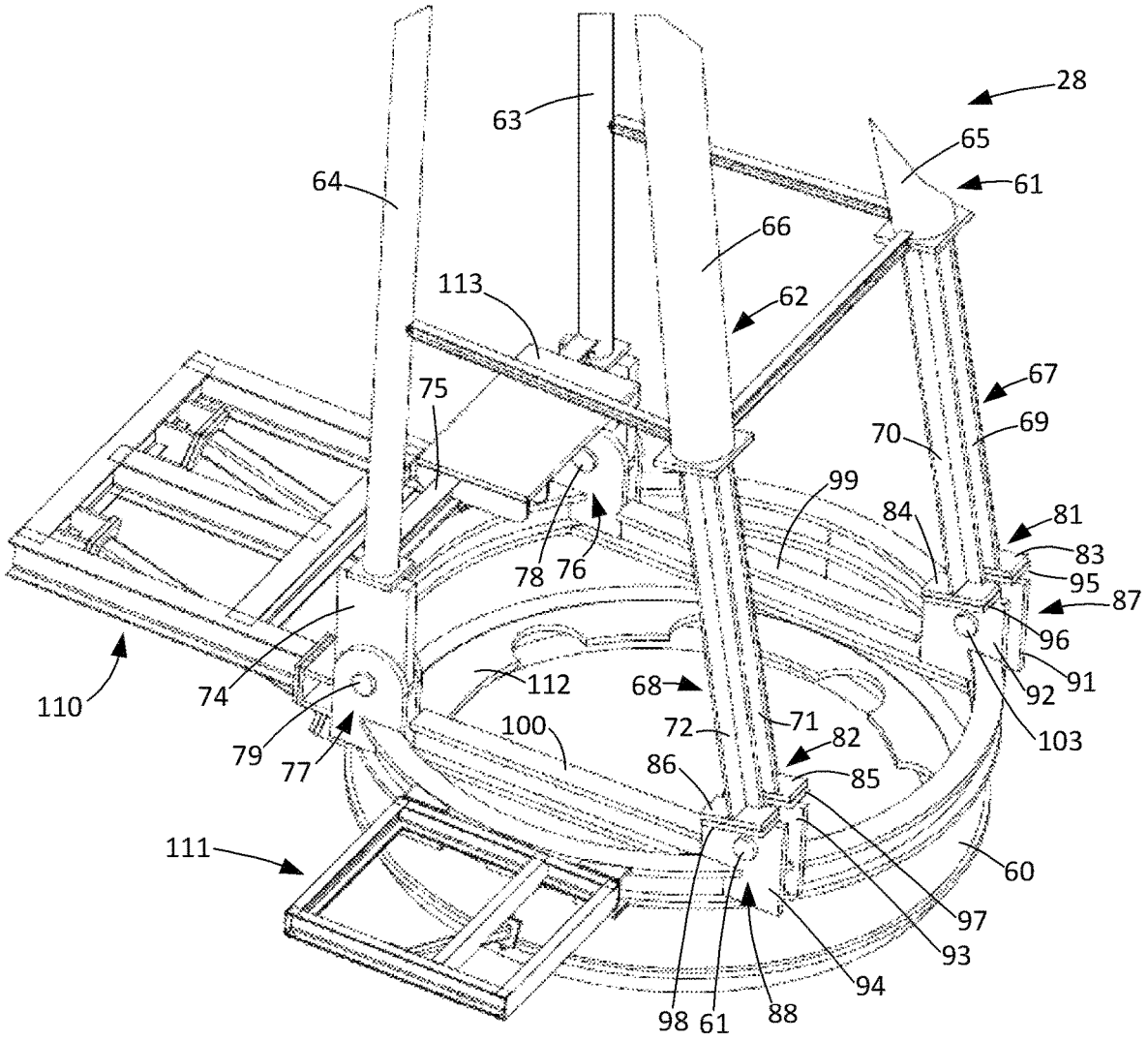
FIG. 13 is an oblique view of the assembly of FIG. 9.
Figure 14:
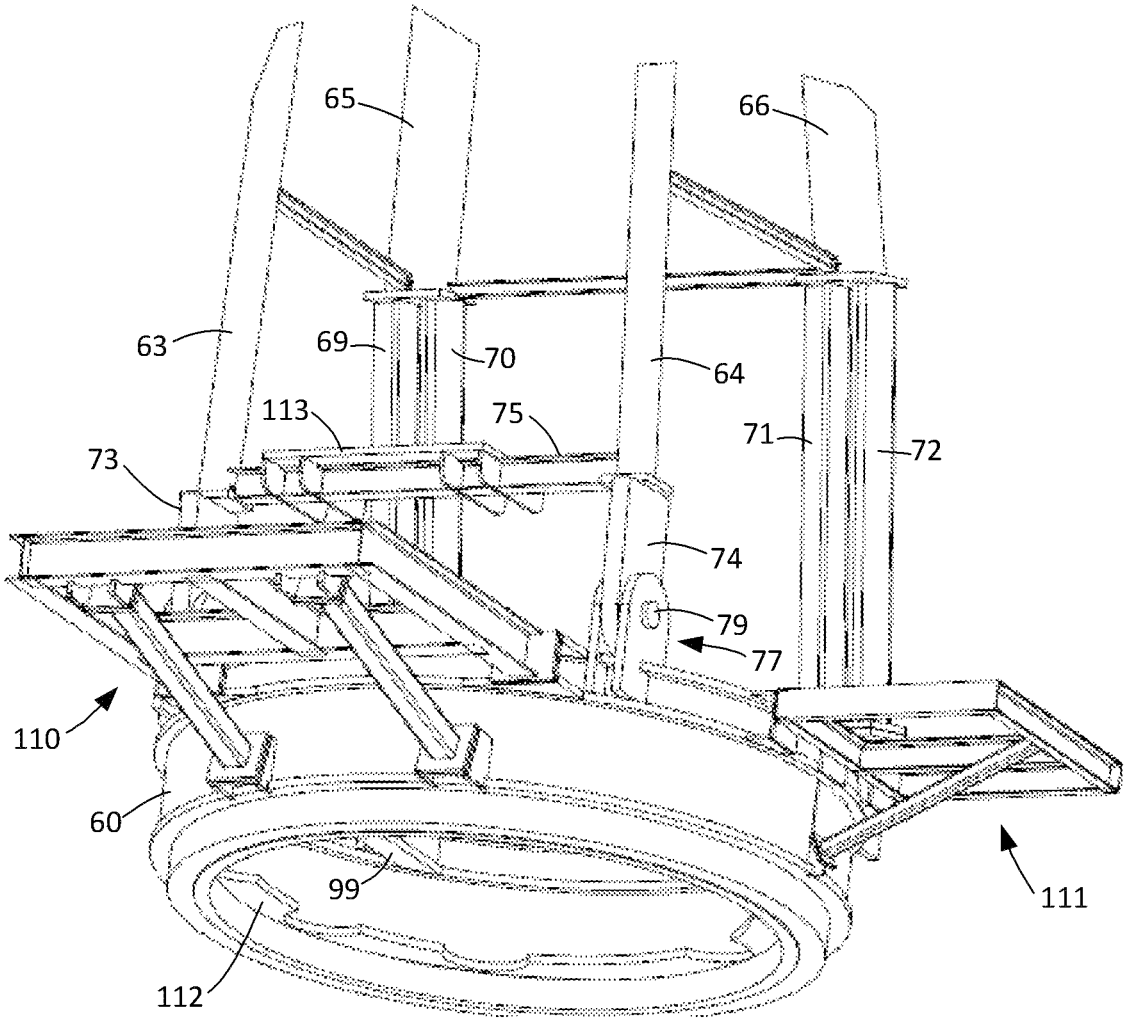
FIG. 14 is another oblique view of the assembly of FIG. 9.

FIG. 10 shows that the front attachment locations 87, 88 (for the gantry front leg and the legs of the boom) and also the rear attachment locations 78, 79 (for the gantry rear legs) are each aligned over the circle of the turret 60. As shown in FIGS. 21-24, with a frustoconical turret 60, the front attachment locations 87, 88 (for the gantry front leg and the legs of the boom) and also the rear attachment locations 78, 79 (for the gantry rear legs) are each aligned over the upper circle 602 of the turret 60. In addition, the attachment locations 87, 88, 78, 79 are located at respective corners of a square. In other examples, the attachment locations 87, 88, 78, 79 may be located at respective corners of a rectangle or other cyclic quadrilateral. FIG. 10 also shows that the hydraulic motor mounting structure 112 mounts a circular array of hydraulic motors 122, 123, 124, 125, 126, 127, 128 shown in dashed line representation. Each of the hydraulic motors drives a respective pinion that meshes with a common internal ring gear mounted to the pedestal (21 in FIG. 2). The respective pinion is coaxial with a central vertical axis of each gearbox, and the respective pinion is located at the bottom of each motor. In at least one example, gear boxes with eccentricity may be utilized such that the respective pinion can be parallel with the central vertical axis of each gearbox. The common internal ring gear is coaxial with the vertical axis (36 in FIG. 2) of the pedestal (21 in FIG. 2). Therefore, the hydraulic motors can be powered to selectively rotate the turret 60 about the vertical axis of the pedestal in order to swing the boom (23 in FIG. 2) around the pedestal.

Figure 15:
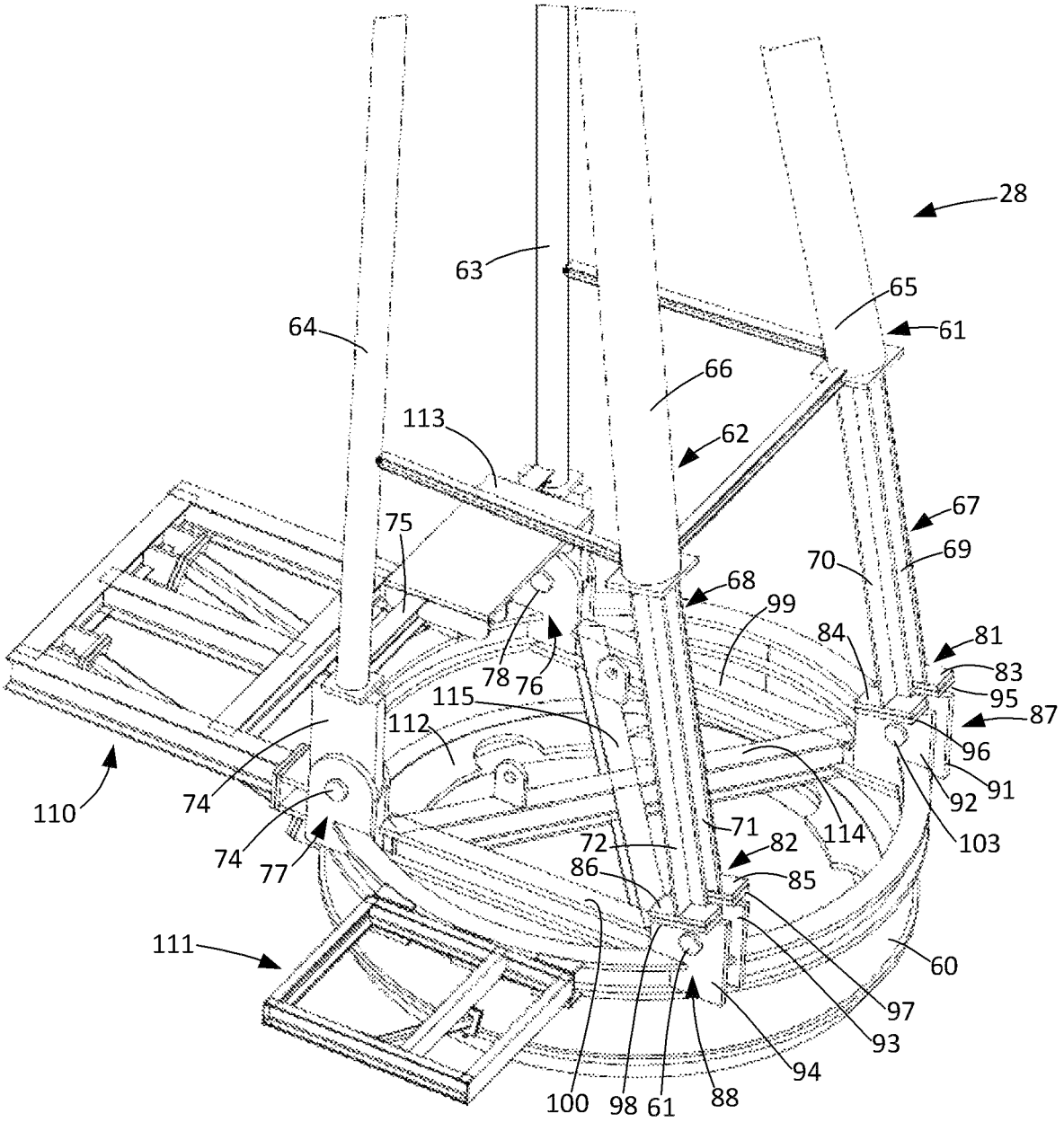
FIG. 15 is an oblique view of the assembly of FIG. 9 after the addition of optional cross bracing within the turret.

As shown in FIG. 15, optional cross beams 114, 115 have been added to further strengthen the turret 60. This permits the turret 60 to be used in a crane having an increased load capacity in comparison to a crane that would not use the cross beams 114, 115.

FIGS. 16 to 19 show alternative constructions for front attachment locations. In each of these examples, a front gantry leg, which is inclined in a direction away from the boom, is mechanically coupled to the front attachment location of the boom so that the front gantry leg applies, to the front attachment location, a horizontal force component towards the boom that is opposed by a horizontal force component applied by the boom towards the front leg.

Figure 16:
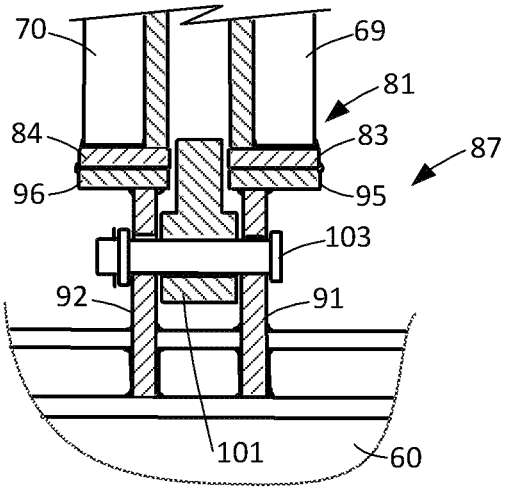
FIG. 16 is a front section view showing the shared connection of the left front gantry leg and the left leg of the proximal end of the boom to the upperstructure.

FIG. 16 shows a front section view of the left front attachment location 87. As described above, the foot 81 of the left front gantry leg includes a pair of inclined steel plates 83, 84 attached to respective ones of the parallel spaced beams 69, 70. The left front attachment location 87 includes a pair of vertical parallel spaced steel plates 91, 92 welded to the turret 60 over the circle of the turret, and a pair of inclined steel plates 95, 96 welded to respective ones of the vertical parallel spaced steel plates 91, 92. The inclined steel plates 83, 84 on the foot 81 of the left front gantry leg rest upon and are attached to respective ones of the inclined steel plates 95, 96 on the left front attachment location 87. The left leg 101 on the proximal end of the boom is received between the beams 69, 70 and the plates 83, 84 and 95, 96 and 91, 92. The left front foot pin 103 pivotally attaches the left leg 101 of the boom to the vertical steel plates 91, 92 of the left front attachment location 87.

Figure 17:
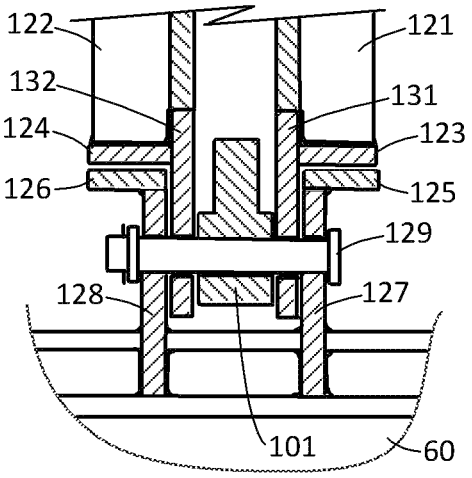
FIG. 17 is a front section view showing an alternative construction in which a left foot pin attaches both the left front gantry leg and the left leg of the boom to the upperstructure.

FIG. 17 shows an alternative construction in which a left foot pin 129 attaches both a left front gantry leg and the left leg 101 of the boom to the upperstructure. In this example, the lower portion of the left front gantry leg still includes a pair of parallel spaced steel beams 121, 122 so that the left leg 101 of the boom can be received between the parallel spaced steel beams 121, 122 when the boom has a maximum upward inclination. The foot of the left front gantry leg also has a pair of inclined steel plates 123, 124 welded to the ends of respective ones of the parallel spaced steel beams 121, 122. In addition, parallel spaced steel pad-eye plates 131, 132 are welded to the ends of respective ones of the parallel spaced steel beams 121, 122. The pad-eye plates 131, 132 are received between a pair of vertical parallel spaced steel plates 127, 128 welded to the turret 60. Two inclined steel plates 125, 126 are welded on top of respective ones of the vertical parallel spaced steel plates 127, 128 so that the inclined plates 123, 124 on the foot of the left front gantry leg may rest upon respective ones of the inclined plates 125, 126 during assembly of the gantry onto the upperstructure. The inclined plates 123, 124, 125, and 126 could be omitted without loss of function by using jacks to load or unload the gantry from the left foot pin 129. The foot of the boom left leg 101 is received between the parallel spaced steel pad-eye plates 131, 132. The single left foot pin 129 pivotally attaches the left leg 101 of the boom to the upperstructure and also attaches the left front leg of the gantry to the upperstructure by passing through the eyes of the pad-eye plates 131, 132.

Figure 18:
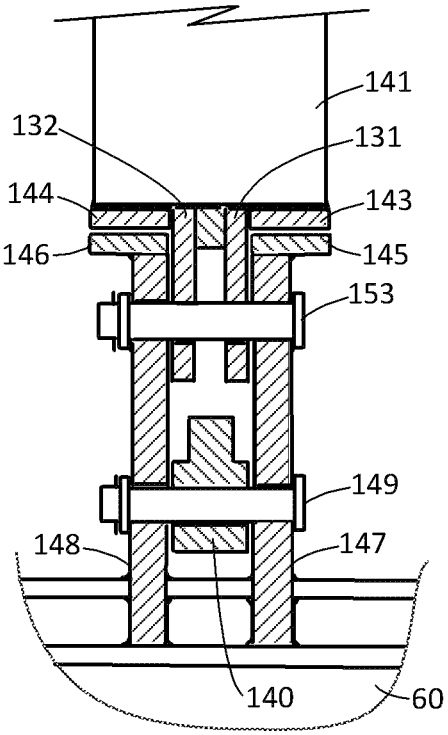
FIG. 18 is a front section view showing an alternative construction of a shared connection using a first foot pin for attaching a left front gantry leg to the upperstructure and a second foot pin for attaching a left boom leg the upperstructure.

FIG. 18 is a front section view of an alternative construction for a shared connection of a left front gantry leg 141 and a left boom leg 140 to the upperstructure. In this example, the shared connection includes a first foot pin 153 for attaching the left front gantry leg 141 to the upperstructure and a second foot pin 149 for pivotally attaching the left boom leg 140 to the upperstructure. The foot of the left front gantry leg 141 includes a pair of inclined steel plates 143, 144 welded to the bottom of the left front gantry leg 141, which is a cylindrical steel tube. Two parallel spaced steel pad-eye plates 131, 132 are also welded to the bottom of the left front gantry leg 141. The pad-eye plates 131, 132 are received between a pair of parallel-spaced vertical steel plates 147, 148 welded to the turret 60. Two inclined steel plates 145, 146 are welded on top of respective ones of the vertical steel plates 147, 148. The inclined plates 143, 144 welded to the bottom of the left front gantry leg 141 rest upon respective ones of the inclined plates 145, 146 during assembly of the gantry onto the upperstructure. The inclined plates 143, 144, 145, and 146 could be omitted, and then the bottom of the gantry leg 141 could rest on the top of each of the vertical plates 147, 148 during assembly of the gantry onto the upperstructure. The first foot pin 153 passes through the vertical steel plates 147, 148 and the eyes of the pad-eye plates 131, 132 to attach the left front gantry leg 141 to the upperstructure. The second foot pin 149 passes through the vertical steel plates 147, 148 and the foot of the left leg 140 of the boom to pivotally attach the left leg 140 of the boom to the upperstructure.

Figure 19:
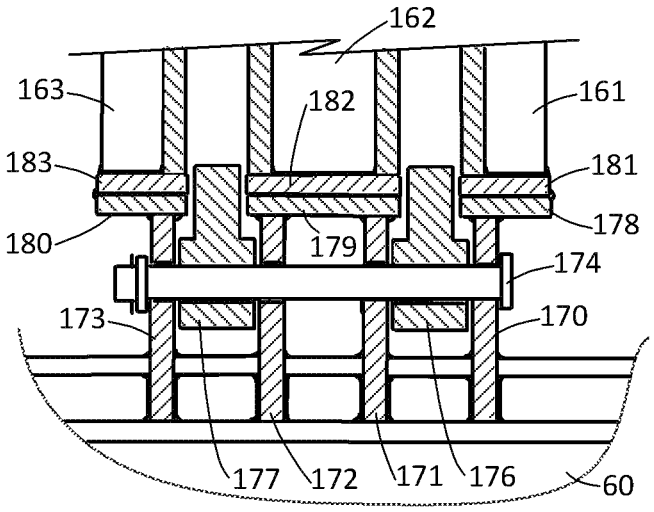
FIG. 19 is a front section view showing an alternative construction of a front attachment location for a crane that has a single front gantry leg and both the single front gantry leg and the proximal end of the boom are attached to the upperstructure at this front attachment location.

FIG. 19 is a front section view showing an alternative construction of a front attachment location for a crane that has a single front gantry leg and both the single front gantry leg and the proximal end of the boom are attached to the upperstructure at this front attachment location. This alternative construction is derived from the construction in FIG. 7 by moving the two front gantry legs (61, 62 in FIG. 7) towards each other over the circle of the turret 60 until the two front gantry legs merge into a single front gantry leg having three parallel-spaced steel beams 161, 162, 163. In this example, the outer steel beams 161, 163 each have a "T" shaped cross section, and the middle steel beam 162 has an "I" shaped cross section. The proximal end of the boom still has a left leg 176 and a right leg 177 but these two legs 176, 177 are closer together.

In FIG. 19, the left leg 176 of the boom is received between a first pair of parallel spaced vertical steel plates 170, 171 welded to the turret 60. The right leg 177 of the boom is received between a second pair of parallel spaced vertical steel plates 172, 173 welded to the turret. An inclined steel plate 178 is welded on top of the vertical plate 170. An inclined steel plate 179 is welded on top of the vertical plates 171 and 172. An inclined steel plate 180 is welded on top of the vertical plate 173. An inclined steel plate 181 is welded on the bottom of the beam 161. An inclined steel plate 182 is welded on the bottom of the beam 162. An inclined steel plate 183 is welded on the bottom of the beam 163. The inclined steel plates 181, 182, 183 rest upon and are attached to the inclined steel plates 178, 179, 180 during assembly of the gantry onto the upperstructure. For example, the inclined steel plates 181, 182, 183 are welded or bolted to the inclined steel plates 178, 179, 180 during assembly. A single foot pin 174 passes through the legs 176, 177 of the boom and through the vertical steel plates 170, 171, 172, 173 to pivotally attach the legs 176, 177 of the boom to the upperstructure.

The alternative connections in FIGS. 16 to 19 have bilateral symmetry in their front views as shown. However, in some situations, it may be desirable to have asymmetrical connections. One example is a mounting of an undersized boom to the upperstructure of a crane having a turret and a four-leg gantry as described above. The undersized boom may have two legs that are spaced from each other by a distance shorter than the distance between the feet of the two front gantry legs. In this case, for example, the foot of the left front gantry leg would not be centered over the foot of the left leg of the boom, and the foot of the right front gantry leg would not be centered over the foot of the right leg of the boom, and instead the foot of the left front gantry leg would be offset towards the left of the crane, and the foot of the right front gantry leg would be offset towards the right of the crane.

The disclosures shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the examples described above may be modified within the scope of the appended claims.

What is claimed is:

1. A crane comprising:

a base;

an upperstructure rotationally mounted on the base;

a boom having a proximal end pivotally attached to the upperstructure at a front attachment location and having a distal end supporting a load line operable to raise a payload; and a gantry mounted on the upperstructure and having an upper end supporting a boom line coupled to the distal end of the boom operable to support the distal end of the boom;

wherein the gantry includes at least one front leg mechanically coupled to the front attachment location and inclined in a direction away from the boom to apply, to the front attachment location, a horizontal force component towards the boom that is opposed by a horizontal force component applied by the boom towards the front leg; and wherein the upperstructure includes a frustoconical turret forming an upper circle and a lower circle, and the front attachment location is aligned over the upper circle of the frustoconical turret.

2. The crane as claimed in claim 1, wherein a diameter of the upper circle is larger than a diameter of the lower circle.

3. The crane as claimed in claim 1, wherein the base includes a pedestal coupled with the upperstructure, the upperstructure includes a swing circle assembly coupling the upperstructure to the pedestal to be operable to rotate the upperstructure about a vertical axis of the pedestal.

4. The crane as claimed in claim 3, wherein the swing circle assembly includes a ring bearing coupled with the lower circle of the turret.

5. The crane as claimed in claim 1, wherein a leg extends vertically through the base, and wherein the upperstructure is positioned about the leg.

6. The crane as claimed in claim 1, wherein the at least one front leg extends from the front attachment location to the upper end of the gantry.

7. The crane as claimed in claim 1, wherein the horizontal force component applied by the front leg towards the boom is equal to the horizontal force component applied by the boom towards the front leg.

8. The crane as claimed in claim 1, wherein the front leg carries a compressive force having a line of action passing through a pivot axis of the boom.

9. The crane as claimed in claim 8, wherein the pivot axis of the boom is a longitudinal axis of a foot pin pivotally attaching the proximate end of the boom to the upperstructure.

10. The crane as claimed in claim 1, which further includes a foot pin pivotally attaching the proximate end of the boom to the upperstructure at the front attachment location, and the foot pin also attaches the front leg of the gantry to the upperstructure at the front attachment location.

11. The crane as claimed in claim 1, wherein the gantry includes a left front leg and a right front leg, the left front leg extends from a left front attachment location on the upperstructure to the upper end of the gantry, and the right front leg extends from a right front attachment location on the upperstructure to the upper end of the gantry.

12. The crane as claimed in claim 11, wherein the left front attachment location is aligned over the upper circle of the turret, and the right front attachment location is aligned over the upper circle of the turret.

13. The crane as claimed in claim 11, wherein the upperstructure includes a pair of parallel spaced vertical plates at each of the left front and the right front attachment locations, and the proximal end of the boom includes a pair of legs, and a foot of each of the pair of legs of the boom is disposed between the parallel spaced vertical plates at a respective one of the left front and the right front attachment locations, and a respective foot pin attaches the foot of each of the legs of the boom to the parallel spaced vertical plates at the respective one of the left front and the right front attachment locations.

14. The crane as claimed in claim 13, wherein a foot of each of the left front leg and the right front leg of the gantry is secured on top of the parallel spaced plates at a respective one of the left front and the right front attachment locations.

15. The crane as claimed in claim 14, wherein each of the left front leg and the right front leg includes a pair of parallel spaced beams extending upward from a respective one of the left front and the right front attachment locations, and an upper and rearward portion of a respective leg of the boom is receivable between the pair of parallel spaced beams in each pair of parallel spaced beams when the boom is at a maximum upward inclination.

16. A crane comprising:

a base; and an upperstructure operable to be rotationally mounted on the base, the upperstructure including a frustoconical turret forming an upper circle and a lower circle, wherein the lower circle is adjacent to the base.

17. The crane of claim 16, wherein a diameter of the upper circle being larger than a diameter of the lower circle.

18. The crane as claimed in claim 16, wherein the upperstructure includes a swing circle assembly coupling the upperstructure to the base operable to rotate the upperstructure about a vertical axis of the base.

19. The crane as claimed in claim 18, wherein the swing circle assembly includes a ring bearing coupled with the lower circle of the frustoconical turret.

20. The crane as claimed in claim 16, wherein a leg extends vertically through the base; wherein the upperstructure is positioned about the leg.

21. The crane as claimed in claim 16, wherein a front attachment location of the upperstructure to pivotally attach a proximal end of a boom is aligned over the upper circle of the frustoconical turret.

22. The crane as claimed in claim 21, further comprising a boom pivotally coupled with the upperstructure; and a gantry including at least one front leg mechanically coupled to the front attachment location and inclined in a direction away from the boom to apply, to the front attachment location, a horizontal force component towards the boom that is opposed by a horizontal force component applied by the boom towards the front leg.

23. The crane as claimed in claim 22, wherein the horizontal force component applied by the front leg towards the boom is equal to the horizontal force component applied by the boom towards the front leg.

24. The crane as claimed in claim 22, wherein the at least one front leg extends from the front attachment location to an upper end of the gantry.

* * * * *